US005604981A

United States Patent [19]

Frazier et al.

[11] Patent Number: 5,604,981

[45] Date of Patent: Feb. 25, 1997

[54] METHOD OF MAKING AN AUTOMOTIVE EVAPORATOR

[75] Inventors: Kathleen L. Frazier, Farmington Hills, Mich.; Kevin B. Wise, Connersville, Ind.; David W. Bertrand, Warren, Mich.

[73] Assignee: Ford Motor Company, Dearborn, Mich.

[21] Appl. No.: 417,554

[22] Filed: Apr. 6, 1995

[51] Int. Cl.[6] ..... B23P 15/26

[52] U.S. Cl. ..... 29/890.039; 29/890.054

[58] Field of Search ..... 29/890.039, 890.054, 29/428; 165/170

[56] References Cited

U.S. PATENT DOCUMENTS

| | | | |
|---|---|---|---|
| 876,361 | 1/1908 | Kraft et al. . | |
| 2,768,508 | 10/1956 | Guyton . | |
| 3,258,832 | 7/1966 | Gerstung . | |
| 4,434,643 | 3/1984 | Almqvist et al. . | |
| 4,996,950 | 3/1991 | Le Mer | 165/170 |
| 5,125,453 | 6/1992 | Bertrand et al. . | |
| 5,152,337 | 10/1992 | Kawakatsu et al. . | |
| 5,195,240 | 3/1993 | Shuster et al. | 29/890.039 |
| 5,369,883 | 12/1994 | So et al. | 29/890.054 |

*Primary Examiner*—Irene Cuda
*Attorney, Agent, or Firm*—Raymond L. Coppiellie

[57] ABSTRACT

A method for making a plate-tube heat exchanger 10 is disclosed. The method includes the steps of forming a generally planar plate blank 36 from a deformable sheet of material, forming an aperture 38 at one end of the plate blank and forming a plurality of generally elongate bead preforms 40 in a predetermined configuration by drawing the material from the bottom surface of the plate blank towards the top surface. Next, a plurality of individual beads 34 are formed from each of the plurality of bead preforms by reverse drawing the bead preforms in a direction from the top surface of the plate towards the bottom surface of the plate. The method of the present invention concludes by forming the finish edges 46 of the plate.

8 Claims, 3 Drawing Sheets

METHOD OF MAKING AN AUTOMOTIVE EVAPORATOR

BACKGROUND OF THE INVENTION

1. Field of the Invention

The present invention relates generally to a heat exchanger for an automotive vehicle. More particularly, the present invention relates to a method for manufacturing a plate for a plate-tube type evaporator.

2. Disclosure Information

Plate-tube heat exchangers are well known in the art. In these types of heat exchangers, a plurality of elongated plates are joined together, such as through a lamination process to define a plurality of passageways for the movement of a fluid therethrough. Each of the passageways is formed by the inwardly facing surfaces of a pair of joined plates. The interior surfaces of the joined plates generally define a central fluid conducting section. The passageways are interconnected so that a fluid may flow through the plurality of joined plates forming the heat exchanger. As is also known in the art, conductive fin strips are located between outwardly facing surfaces of the pairs of joined plates. Heat exchangers of this type have particular utility as evaporators for air conditioning systems of motor vehicles, and one such heat exchanger is described in U.S. Pat. No. 5,125,453, assigned to the assignees of the present application.

Typically, the plates used in heat exchangers such as described in the '453 patent are formed by stamping or pressing the plate configuration from a sheet of deformable material, such as steel or aluminum. As shown in the '453 patent, the plates include a plurality of beads which act to disrupt the flow of fluid between pairs of plates. The beads are formed in a single drawing process, wherein each of the beads are formed in one operation. Although adequate in most applications, it has been determined that drawing the beads in a single operation can cause microcracking around the sharp corners of the beads. These cracks result in leakage of the plates and ultimately in reduced effectiveness of the heat exchanger. Therefore, it would be desirable to form the plates so that cracking at the beads does not occur.

It is an advantage of the present invention to provide a method of making the heat exchanger plates to reduce cracking and leakage around the beads.

SUMMARY OF THE INVENTION

The present invention overcomes the above problems with the prior art by providing a method of making a heat exchanger plate of the kind having an end portion including apertures for transporting a heat exchange medium therethrough, the plate being configured to be joined to a similar plate in face-to-face contact to form a fluid passageway for the heat exchange medium to flow therethrough, the method comprising the steps of providing a sheet of deformable material and forming a generally planar plate blank from the deformable sheet of material, the plate blank defining a top surface, a bottom surface, a first end and a second end. The method further includes the steps of forming an aperture at one end of the plate blank and forming a plurality of generally elongate bead preforms in a predetermined configuration by drawing the material from the bottom surface of the plate blank towards the top surface, the bead preforms projecting from the plane of the plate blank by a predetermined height. Next, a plurality of individual beads are formed from each of the plurality of bead preforms by reverse drawing the bead preforms in a direction from the top surface of the plate towards the bottom surface of the plate, each bead of the plurality having a height approximately equal to the height of the bead preform. The method of the present invention concludes by forming the finish edges of the plate.

It is an advantage of the present invention to provide a method of making a heat exchanger plate which reduces the likelihood of leakage resulting from the manufacturing process.

DETAILED DESCRIPTION OF THE PREFERRED EMBODIMENTS

Figure 2:
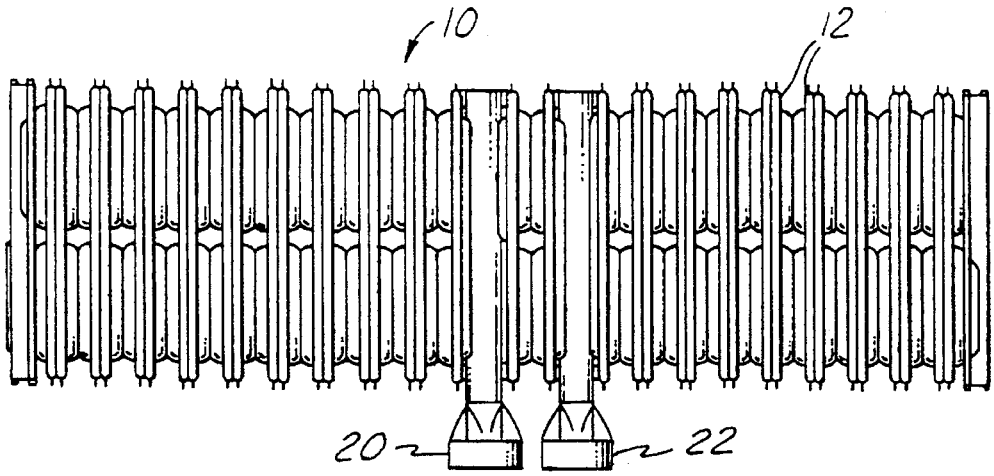
FIG. 2 is a top plan view of the heat exchanger of FIG. 1.
Figure 1:
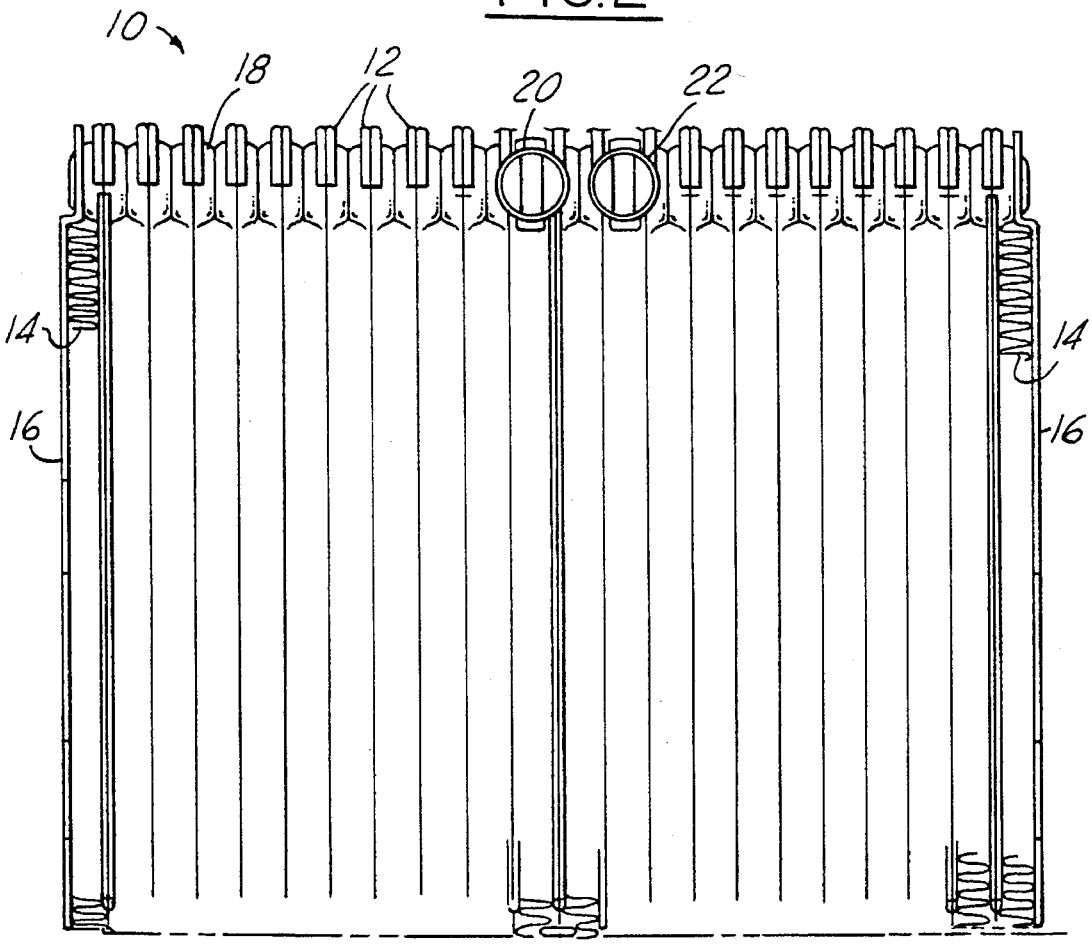
FIG. 1 is a perspective view of a heat exchanger structured in accord with the principles of the present invention.

Referring now to the drawings, FIGS. 1 and 2 show a plate-tube heat exchanger, generally designated by the numeral 10, in the form of an evaporator particularly adapted for use in an automobile air conditioning system. The heat exchanger 10 comprises a stack of formed, elongated plates 12, pairs of which are joined together in face-to-face relationship so that adjacent pairs form tubes to provide alternate passageways for the flow of refrigerant therebetween as will be described further below. The plates may be joined in any of a variety of known processes, such as through brazing or a lamination process. Heat transfer fins 14 are positioned between joined pairs of plates 12 to provide increased heat transfer area as is well known in the art. The joined plate pairs and fin assemblies are contained within endsheets 16.

The heat exchanger 10 includes an inlet port 20 and an outlet port 22 formed within a header 18 at either one or both ends of the heat exchanger 10. The header is in direct communication with the tube passageways between the joined pairs of plates 12 as will become apparent from the following description. The plates 12 have aligned apertures at the ends thereof providing communication between inlet and outlet ports 20, 22, respectively, of header 18. However, as is well known in the art, each of the plates can include apertures at either one or both ends thereof and the inlet and outlet ports 20, 22 can be located at opposite ends of the heat exchanger as is well known in the art. In the heat exchanger FIG. 1, refrigerant is directed into the inlet port 20, passed through the pair plurality of joined plates 12 in a known manner. The refrigerant then exits through outlet port 22 to complete the cooling cycle.

Figure 3:
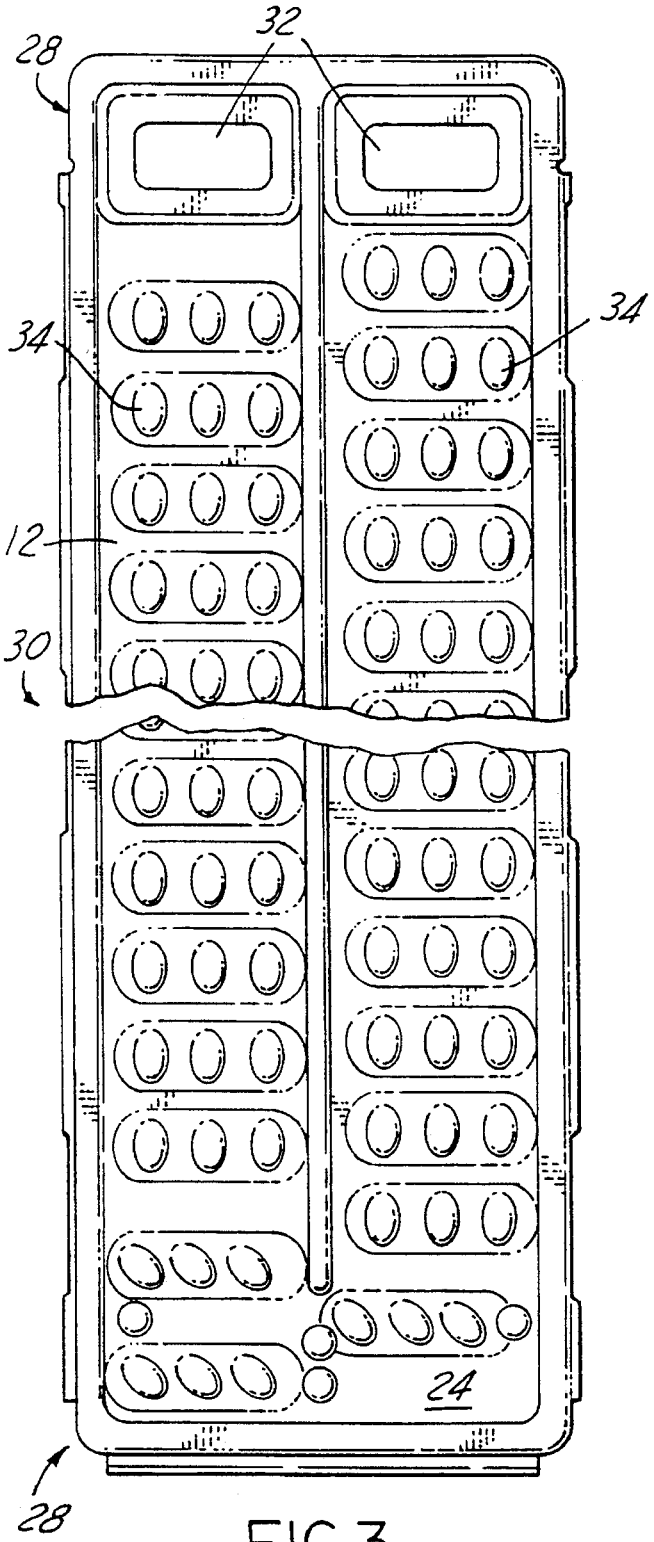
FIG. 3 is a plan view of a finished plate member of the present invention.

As shown in FIG. 3, each of the plate members 12 includes a top surface 24, a bottom surface, a pair of end portions 28 and a generally longitudinal intermediate portion 30 therebetween. As shown in FIG. 3, a pair of apertures 32 are formed at one of the end portions 28. Alternatively, as is well know in the art, apertures can be formed at both ends of the plate. The apertures are aligned when the heat exchanger is assembled to provide for a fluid conduit for the heat exchanger fluid to pass therethrough. Each of the intermediate portions 30 of the plate member 12 includes a plurality of beads 34 which, as is well known in the art, provide a circuitous path for the fluid to pass through the plate tube 12 to increase the turbulence of the fluid and provide for better heat transfer characteristics.

Figure 4:
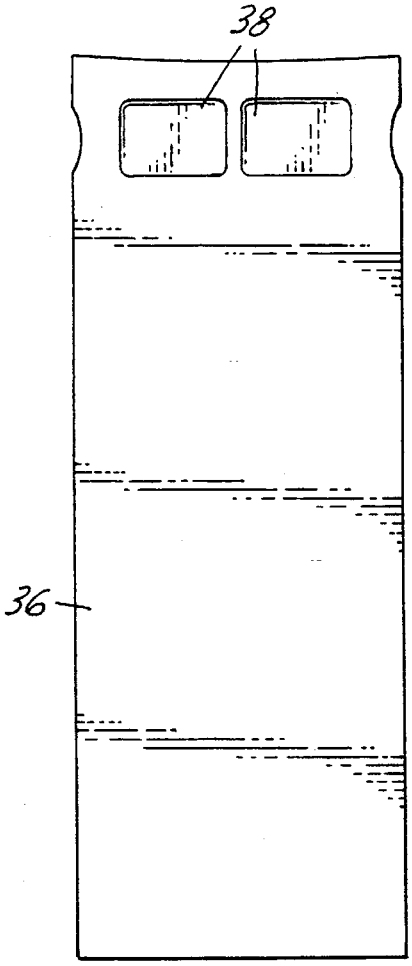
FIGS. 4–7 show the progressive stages in the formation of a plate for the heat exchanger structured in accord with the principles of the present invention.

FIGS. 4–7 show the steps in manufacturing the plate members 12. As shown in FIG. 4, the plate members 12 are formed from a sheet of deformable material. The material can be an aluminum material coated with an aluminum brazing alloy as is known in the art. A sheet of material can either be of a predetermined length with a predetermined number of plate members 12 therein or may be formed as a continuous strip of material which is cut at a predetermined number of plates to form a heat exchanger of predetermined size. The plate members 12 are stamped using pneumatic and hydraulic gauges in a die as is well known in the art.

As shown in FIG. 4, a plate member blank 36 is first formed in the stamping process. The blank 36 includes generally the dimensions of the final plate member. After the blank 36 is formed, a cup-shaped aperture 38 is formed in one end of the blank. As described above, these cup-shaped apertures 38 become connected together in the final assembly to form the header 18 for the fluid entering and exiting the evaporator as described above. It should be understood that an additional aperture can be formed on the opposite end of the plate as well.

Figure 5:
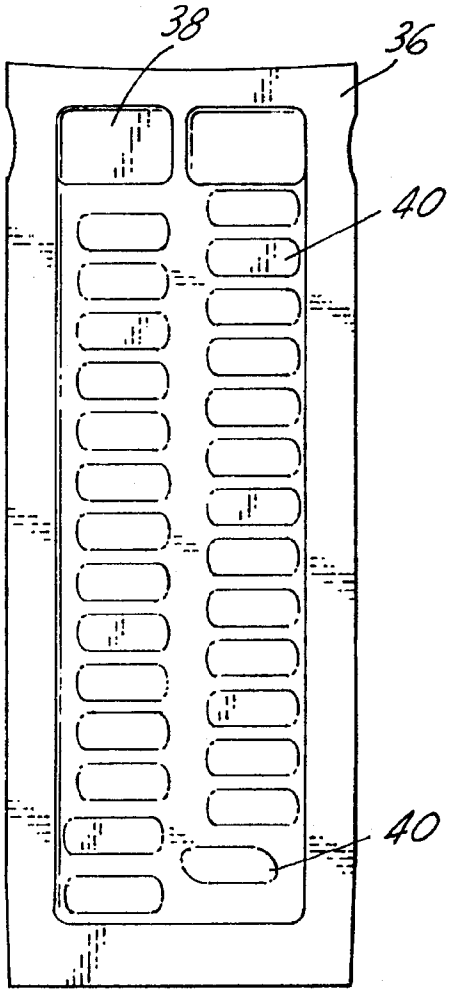

Referring now to FIG. 5, after the apertures are formed, a plurality of bead preforms 40 are drawn next. The bead preforms 40 are drawn from the bottom surface of the plate toward the top surface using a conventional drawing technique. The bead preforms 40 are drawn to the finish height of the beads on the plate 36. Selected bead preforms may be drawn slightly lower than others to reduce bowing of the plate member 36. In the preferred embodiment, the majority of bead preforms 40 are drawn to a height of 0.050 inches, while certain other preforms 40 are drawn to 0.090 inches. It was necessary to draw the majority of the bead preforms 40 to 0.050 inches to reduce bowing of the plate member 36.

Figure 8:
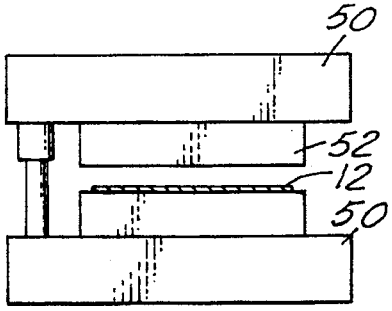
FIG. 8 is a schematic representation of a manufacturing tool used in the production of the plate member according to the principles of he present invention.
Figure 6:
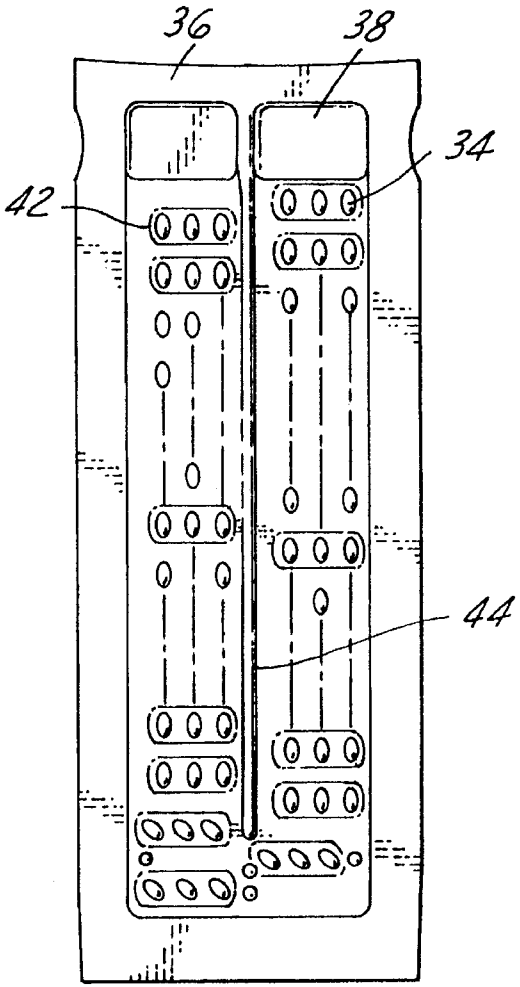

As shown in FIG. 6, after the bead preforms 40 are drawn, the individual beads 34 are formed in each of the preforms. This is done by a reverse drawing process wherein a die contacts the top surface of the bead preforms 40 and pushes the preforms 40 toward the bottom surface of the plate until each of the individual beads are formed to the design height (as schematically illustrated in FIG. 8). This process leaves a coined oblong-shaped slot 42 around each grouping of beads. By utilizing the two-step drawing process, very sharp radii of the beads can be formed without cracking and ultimately without leaking. Furthermore, at this stage in the manufacturing process, a longitudinal rib 44 may be formed at approximately the centerline of the plate member 36. The rib 44 divides the plate into two fluid flow sections. The rib is formed to one-half the height of the beads since ribs on mating plates must also join.

Figure 7:
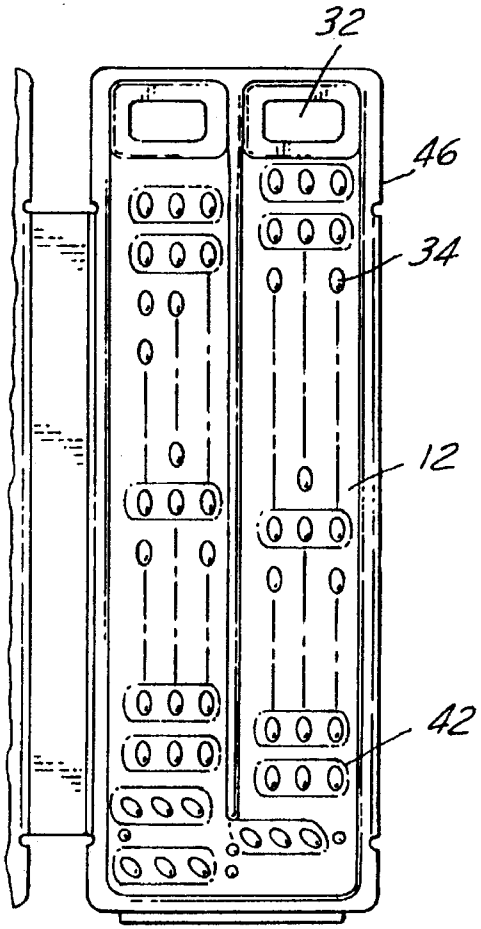

As shown in FIG. 7, the manufacturing of the plate member 12 is completed when the finish edges 46 of the plate are formed and the apertures 38 are formed into the final cup-shaped apertures 32. As is known in the art, the edges 46 provide mating surfaces for joining adjacent plate members together.

FIG. 8 shows a tool 50 for forming the plate members of the present invention. The plate members 12 are stamped using pneumatic and hydraulic gauges in a die 52 either manually controlled as is known in the art or controlled by a PLC\PLS or other computerized means known in the die pressing art. The patterns to be embossed on the plate member are formed on the dies such that when the plate proceeds through the progressive stages in the die, the patterns are formed according to the steps described above.

Various modifications and alterations of the present invention will, no doubt, occur to those skilled in the art to which this invention pertains. For example, any bead pattern can be formed using the method of the present invention. These and all other variations which rely upon the teachings by which this disclosure has advanced the art are properly considered within the scope of this invention as defined by the appended claims.

What is claimed is:

1. A method of making a heat exchanger plate of the kind having an end portion including apertures for transporting a heat exchange medium therethrough, the plate being configured to be joined to a second plate in face-to-face contact to form a fluid passageway for the heat exchange medium to flow therethrough, the method comprising the steps of:

providing a sheet of deformable material;

forming a generally planar plate blank from the deformable sheet of material, the plate blank defining a top surface, a bottom surface, a first end and a second end;

forming an aperture at one end of the plate blank;

forming a plurality of generally elongate bead preforms in a predetermined configuration by drawing the plate blank from the bottom surface of the plate blank towards the top surface, the bead preforms projecting from the plane of the plate blank by a predetermined height;

forming a plurality of individual beads in each of the plurality of bead preforms by reverse drawing the bead preforms in a direction from the top surface of the plate blank towards the bottom surface of the plate blank; and forming finish edges on the plate blank.

2. A method according to claim 1, wherein the step of forming a plurality of beads includes forming three beads per bead preform.

3. A method according to claim 1, wherein the step of forming a plurality of beads includes forming a generally oblong-shaped groove at the base of the bead preform.

4. A method according to claim 1, wherein each of the forming steps is performed at successive locations in a progressive die.

5. A method according to claim 1, further including the step of forming a generally longitudinal rib along a longitudinal centerline of the plate, the height of the rib being approximately one-half the height of the beads.

6. A method according to claim 1, wherein the step of forming an aperture at one end of the plate blank further includes the step of forming an aperture at both ends of the plate blank.

7. A method of making an evaporator core for use in an automotive vehicle, the core being of the type including a plurality of plate tubes interweaved with fin members, each plate tube comprising a pair of plate members joined together in face-to-face contact to form a fluid passageway for a heat exchange medium to flow therethrough, the method comprising the steps of:

forming a plurality of plate members, said forming step including:

providing a sheet of deformable material;

forming a generally planar plate member blank from the deformable sheet of material, the plate member blank defining a top surface, a bottom surface, a first end and a second end;

forming a cup-shaped aperture at one end of the plate member blank;

forming a plurality of generally elongate bead preforms in a predetermined configuration by drawing the plate member blank from the bottom surface of the plate member blank towards the top surface, said plurality of bead preforms projecting from the plane of the plate member blank by a predetermined height;

forming a plurality of individual beads in each of the plurality of bead preforms by reverse drawing each of the plurality of the bead preforms in a direction from the top surface of the plate member blank towards the bottom surface of the plate member blank, each bead of the plurality having a height approximately equal to the height of the bead preform;

forming a generally longitudinal rib along a longitudinal centerline of the plate member, the height of the rib being approximately one-half the height of the beads;

forming finish edges on the plate member blank;

joining a pair of plate member blanks together in face-to-face abutting relationship to form a plate tube;

interweaving fin members between adjacent plate tubes to form an assembled core;

brazing the assembled core at a predetermined temperature for a predetermined time.

8. A method according to claim 7, wherein the step of forming a plurality of beads includes forming three beads per bead preform.

* * * * *